US007118176B2

(12) United States Patent
Erker

(10) Patent No.: US 7,118,176 B2
(45) Date of Patent: Oct. 10, 2006

(54) BUCKET SEAT WITH INCLINATION-PROFILE ADJUSTING MECHANISM

(75) Inventor: Christian Erker, Zitzergasse 21, D-61250 Usingen (DE)

(73) Assignees: Christian Erker, Usingen (DE); Grammer AG, Amberg (DE)

( * ) Notice: Subject to any disclaimer, the term of this patent is extended or adjusted under 35 U.S.C. 154(b) by 0 days.

(21) Appl. No.: 10/408,687

(22) Filed: Apr. 7, 2003

(65) Prior Publication Data

US 2003/0189367 A1 Oct. 9, 2003

(30) Foreign Application Priority Data

Apr. 7, 2002 (DE) ..... 102 15 285

(51) Int. Cl.
*A47C 3/025* (2006.01)

(52) U.S. Cl. ..... 297/284.1; 297/284.2; 297/452.58; 297/296; 297/297

(58) Field of Classification Search ..... 297/284.1, 297/284.4, 284.9, 362.13, 362.14, 320, 316, 297/300.2, 300.5, 452.58, 452.59, 452.63, 297/452.64, 353, 354.13, 357, 296, 452.39, 297/300.1, 354.12, 297, 284.2
See application file for complete search history.

(56) References Cited

U.S. PATENT DOCUMENTS 2,439,869 A * 4/1948 Sharp ..... 297/296
3,711,156 A * 1/1973 Bloomfield ..... 297/452.13
4,005,903 A * 2/1977 Jenni ..... 297/328
4,443,034 A * 4/1984 Beggs ..... 296/65.17
4,603,904 A * 8/1986 Tolleson et al. ..... 297/296
4,685,733 A * 8/1987 Machate et al. ..... 297/284.4
4,861,106 A * 8/1989 Sondergeld ..... 297/316
5,044,693 A * 9/1991 Yokota ..... 297/452.18
5,209,549 A * 5/1993 Chang ..... 297/320
5,249,839 A * 10/1993 Faiks et al. ..... 297/300.1
5,320,410 A * 6/1994 Faiks et al. ..... 297/296
5,366,274 A * 11/1994 Roericht et al. ..... 297/321
5,472,261 A * 12/1995 Oplenskdal et al. ..... 297/342
5,551,758 A * 9/1996 Leib et al. ..... 297/451.3
5,826,940 A * 10/1998 Hodgdon ..... 297/303.1
6,572,190 B1 * 6/2003 Koepke et al. ..... 297/284.1
6,729,691 B1 * 5/2004 Koepke et al. ..... 297/452.56
6,742,840 B1 * 6/2004 Bentley ..... 297/316

FOREIGN PATENT DOCUMENTS

DE 9714576 10/1998

* cited by examiner

*Primary Examiner*—Peter M. Cuomo
*Assistant Examiner*—Erika Garrett
(74) *Attorney, Agent, or Firm*—Abelman, Frayne & Schwab

(57) ABSTRACT

A bucket seat includes a support surface (14), curved shaped members (1) for supporting the support surface (14), receiving members (2) for receiving respective shaped members (1) and extending in a same direction as the shaped members (1), and an arrangement for rotating the shaped members (1) and the receiving members (2) in opposite direction for changing an inclination of the support surface (14), with an alignment of respective shaped members (1) and the receiving members (2) being maintained.

1 Claim, 8 Drawing Sheets

9
10
14
1
2
4
5
6
7
13

BUCKET SEAT WITH INCLINATION-PROFILE ADJUSTING MECHANISM

BACKGROUND OF THE INVENTION

1. Field of the Invention

The present invention relates to a bucket seat or a similar seat or couch with a support surface supported by curved shaped members.

2. Description of the Prior Art

Bucket seat or similar seating items having a backrest formed of a support surface and curved shaped members supporting the support members, and displaceable between upright and lean-back positions are known. The known seating items have support surfaces the profile of which does not change when the backrest is displaced from an upright position to a lean-back position. Furthermore, the seats with an unchangeable profile of the backrest does not provide for relaxation of the body of a seating person.

Accordingly, an object of the present invention is to provide a seating item, in particular, a bucket seat which would insure a natural relaxation of the body of the seating person without a need in a self-movement correction.

SUMMARY OF THE INVENTION

This and other objects of the present invention, which will become apparent hereinafter, are achieved by a bucket seat having a support surface, which is supported by curved shaped members, receiving members for receiving respective shaped members and extending in a same direction as the shaped members, and an arrangement for rotating the shaped members and the receiving members in opposite direction for changing an inclination of the support surface, with an alignment of respective shaped members and the receiving members being maintained.

Advantageously, the support surface is formed of spaced side members and flexible, in a predetermined direction, covering connected with the side members. The side members are rigid in a direction toward the covering but are bendable in a longitudinal direction. The bucket seat further includes holders for uniformly distributing a tensioning force over the covering. According to the invention, advantageously, the tilting of the seat is adapted to the inclination of the backrest. This prevents sliding of a person forward when the backrest leans back too far. This insures a proper adjustment of the lodosis support. There is further provided means for proper alignment of the headrest with the backrest in all positions of the backrest, which insures a complete relaxation of the shoulder and neck region of a seating person.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

Figure 1:
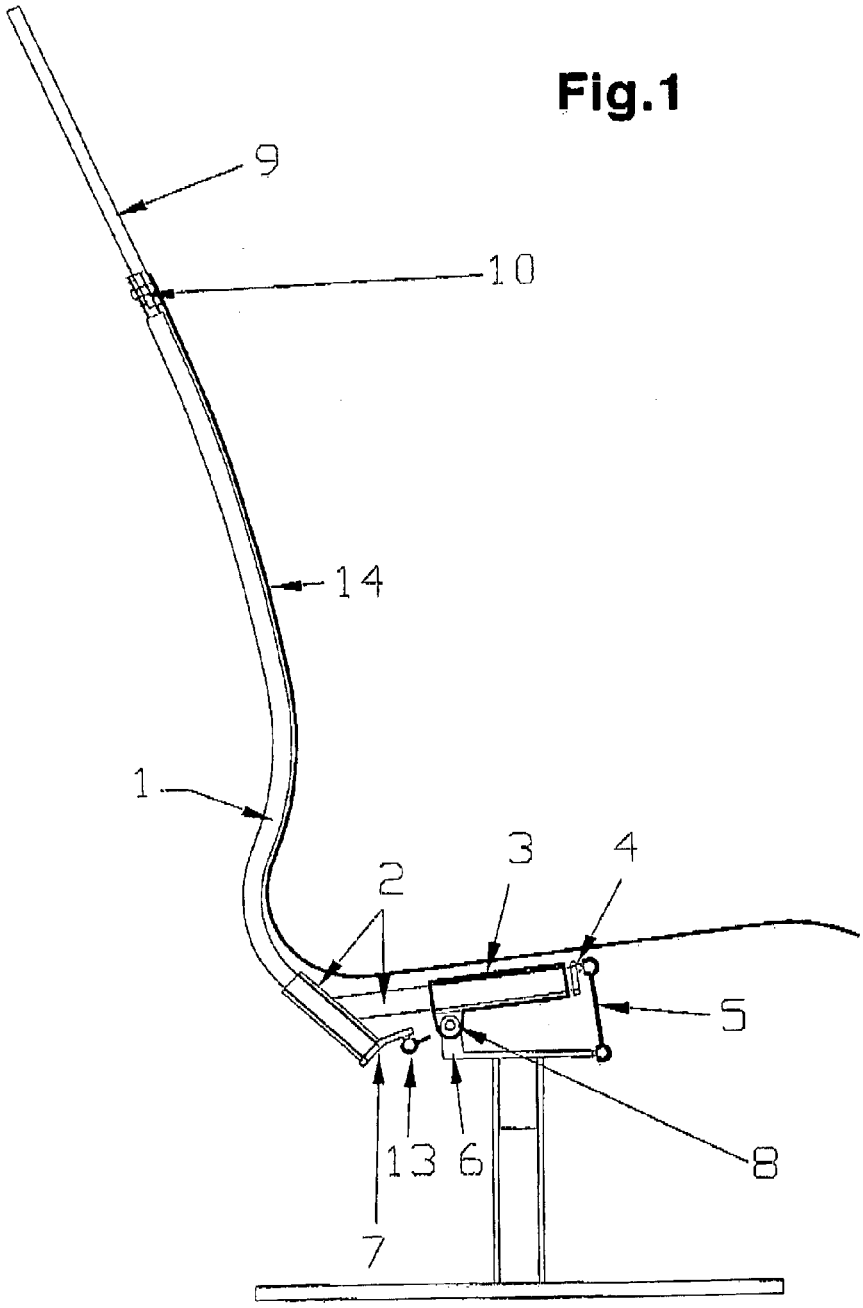
FIG. 1 shows a schematic side view of a bucket seat according to the present invention.
Figure 2:
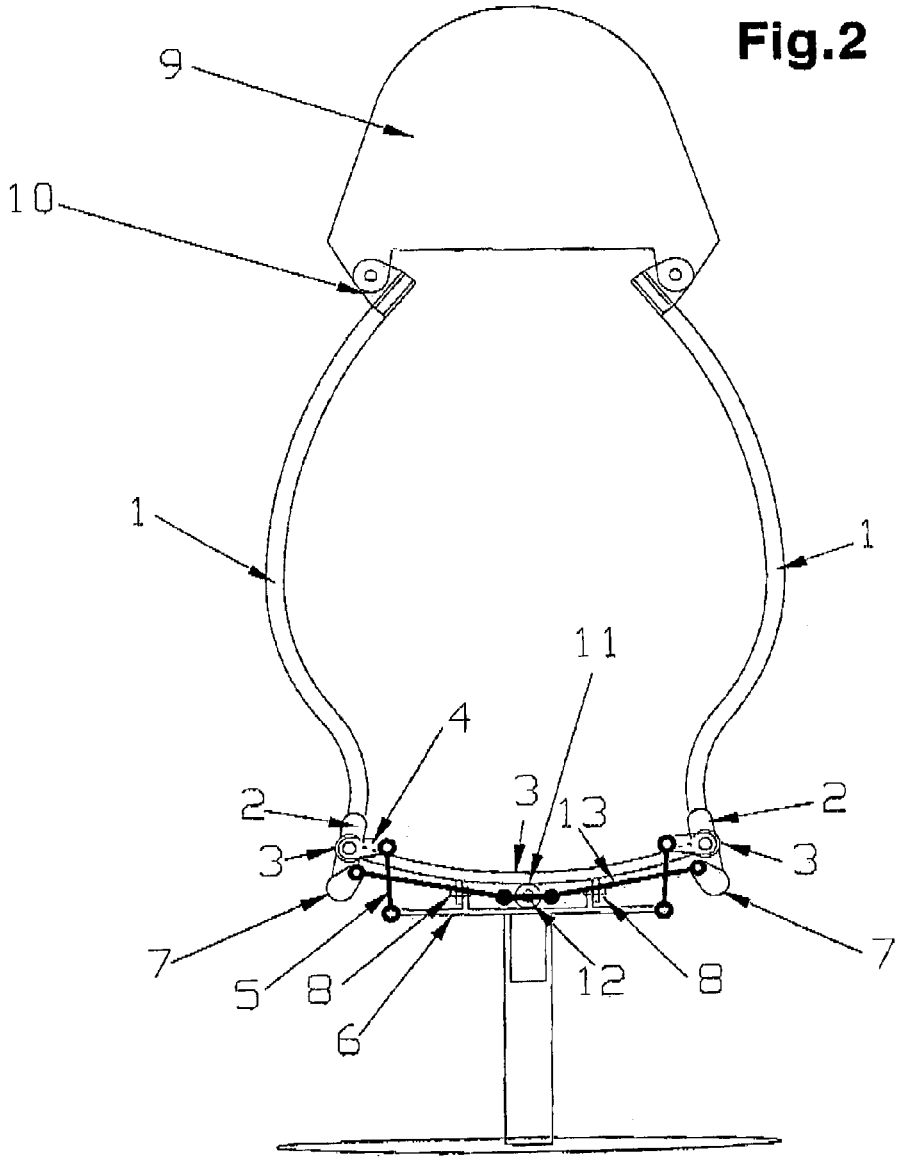
FIG. 2 shows a schematic front view of the bucket seat shown in FIG. 1.

DETAILED DESCRIPTION OF THE PREFERRED EMBODIMENTS:

FIGS. 1–2 show schematically side and front views of the profile of shaped members 1 of a backrest of a bucket seat in an upright position. In the FIGS. 1–2 show schematically side and front views of the profile of shaped members 1 of a backrest of a bucket seat in an upright position. In the embodiment shown in FIGS. 102 the support surface 14 has a profile which is changed by rotation of the shaped members 1. A connection element 10 so connects the headrest 9 with the backrest that the headrest 9 is always aligned with the end of the backrest.

Figure 3:
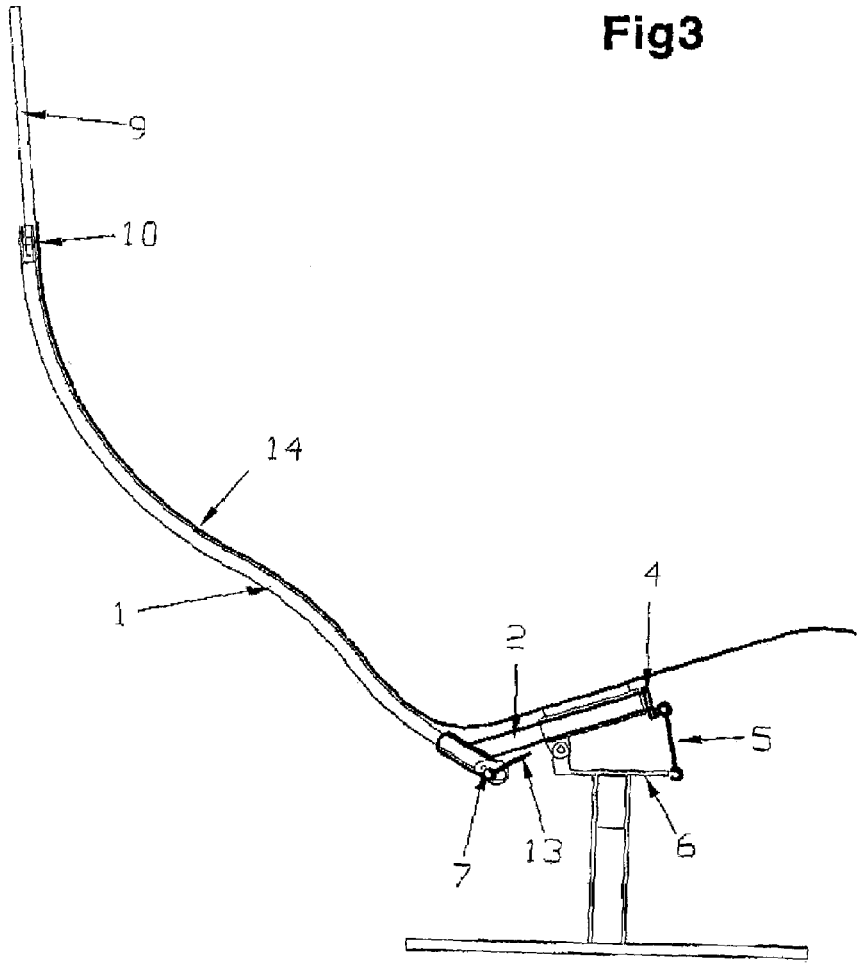
FIG. 3 shows a schematic side view of the bucket seat shown in FIGS. 1–2 in its lean-back position.
Figure 4:
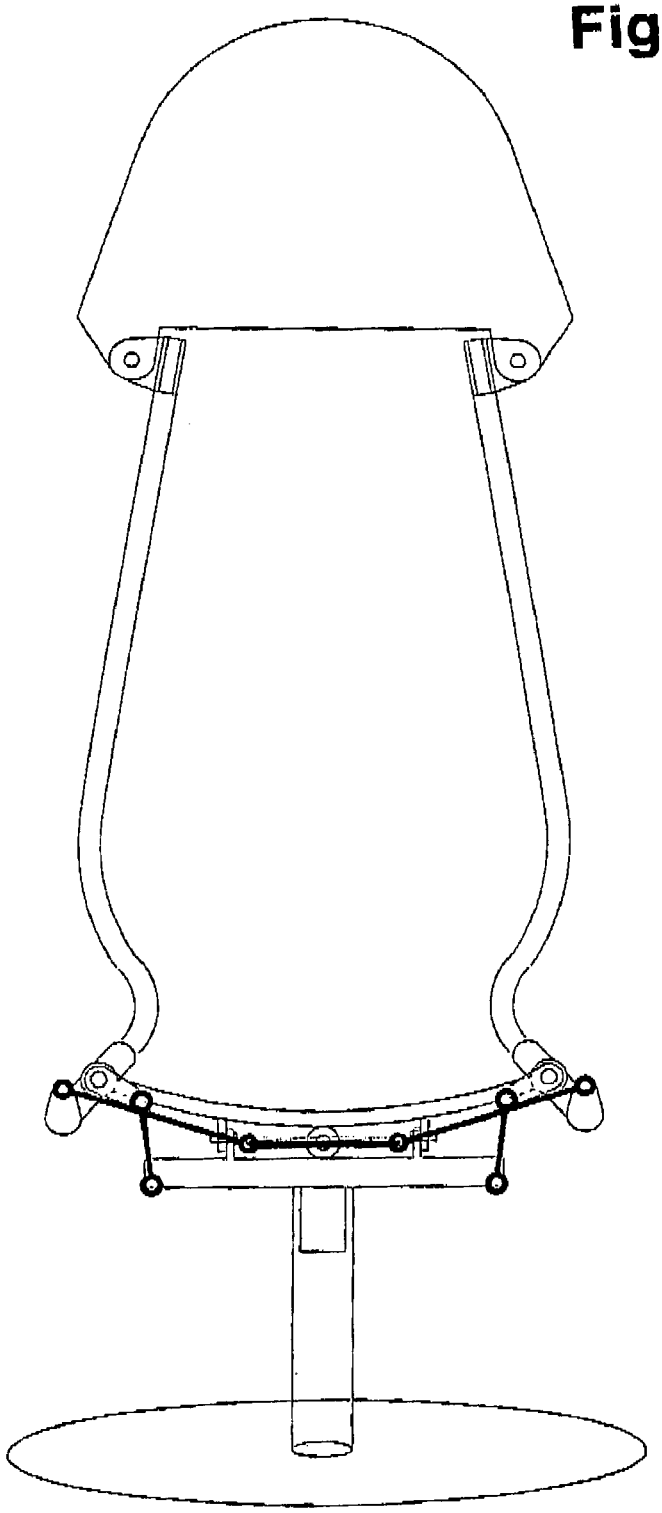
FIG. 4 shows a schematic front view of the bucket seat shown in FIGS. 1–2 in its lean-back positions.
Figure 5:
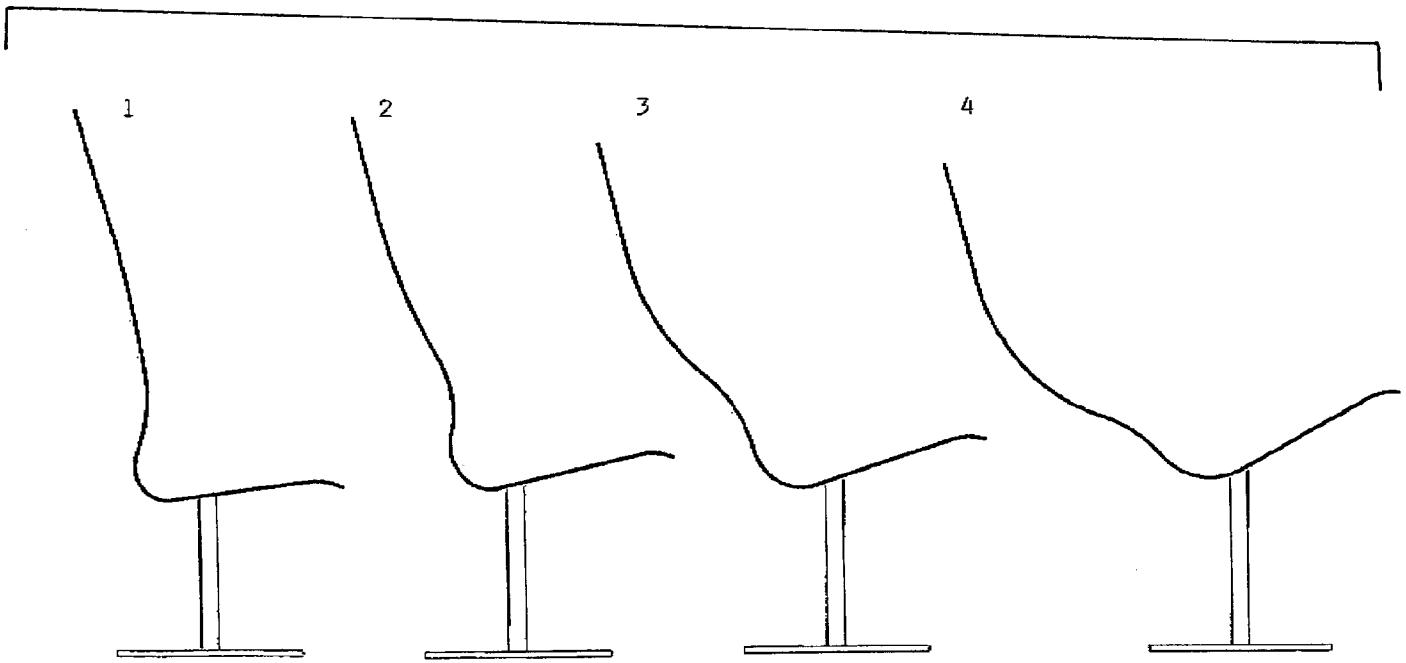
FIG. 5 shows a schematic view illustrating profile changes of the backrest of the bucket seat shown in FIG. 1.

The backrest shaped members 1 are received in receiving members 2, with the inclination of the members 1 being changed by rotation of the members 1 and the receiving members 2 in opposite directions. With the change of inclination of the backrest members 1, the profile of the support surface 14 also changes. The inclined or lean-back position of the backrest is shown in FIGS. 3–4.

The receiving members 2 are rotatably supported in the housing 3 which, in turn, is supported on a base 6 with a possibility of a pivotal movement thereon about a horizontal axle 8. This provides for positioning of the housing 3 in a predetermined titled position.

The rotation of the receiving member 2 is initiated by actuation of a lever 4 which is also connected with a push rod 5 for tilting the housing 3 on the base 6. Thereby, the tilt position of the housing 3 is synchronized with the inclination position of the backrest, whereby the inclination of the backrest, the change of the profile of the support surface 14, and inclination of the tilting position of the seat are synchronized and are effected by operating the lever 4. The synchronization is insured with a scissors mechanism 11 shown schematically in FIG. 6.

Figure 6:
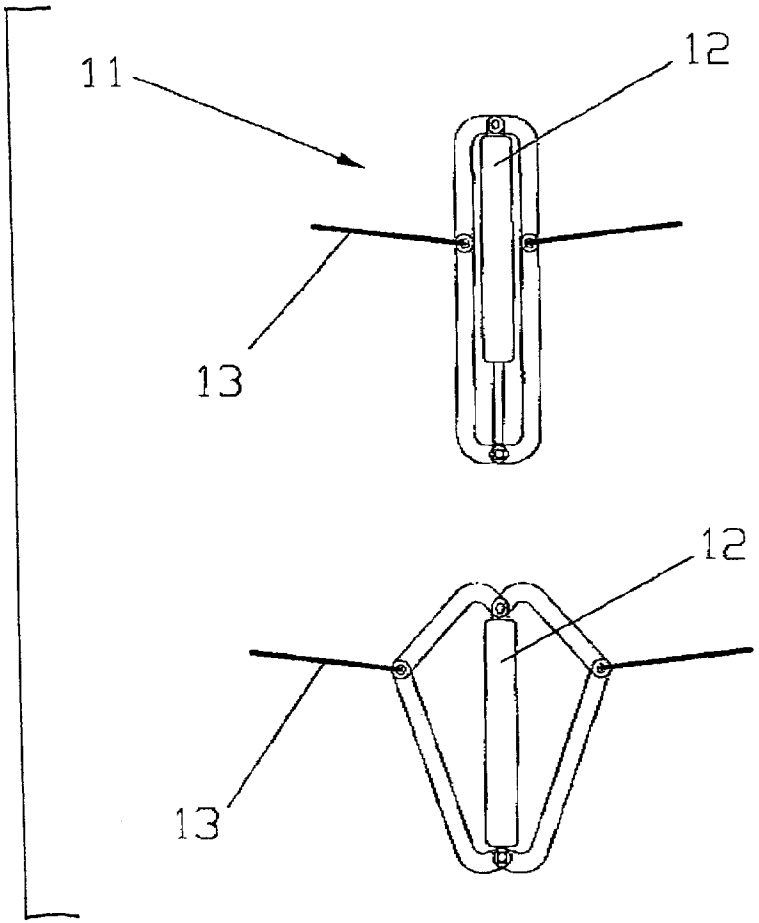
FIG. 6 shows a schematic view of a scissors mechanism for retaining the backrest in a predetermined position.

As shown in FIG. 6, the scissors mechanism 11 has a gas spring 12 and two tie-rods 13 connectable with the receiving members 2. The upper figure in FIG. 6 shows the position of the mechanism 11 in the inclined position of the backrest.

Figure 7:
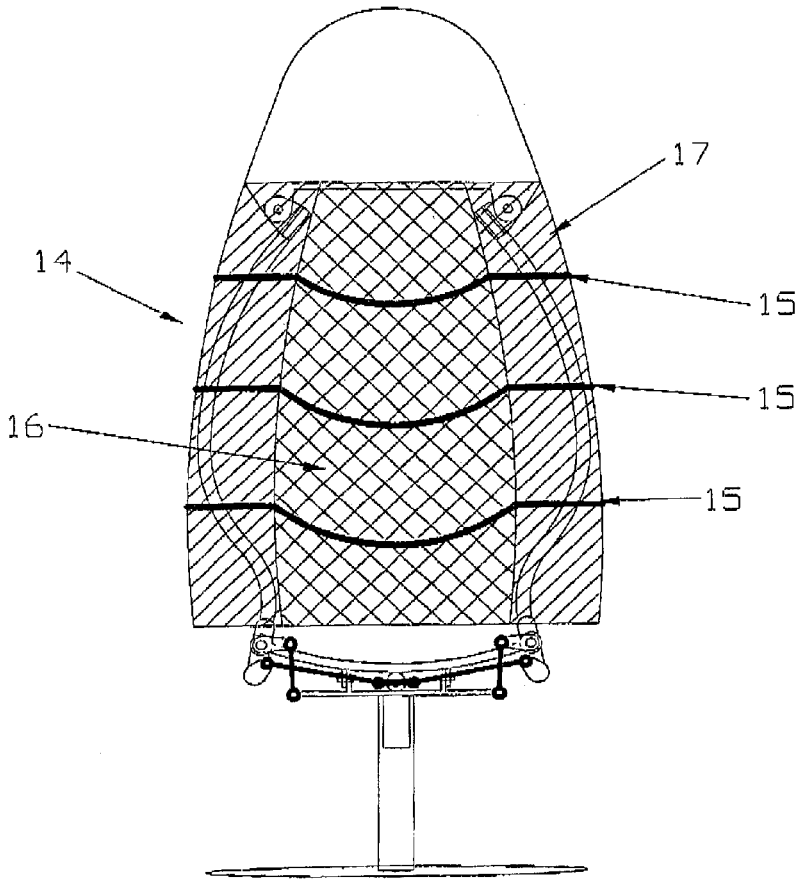
FIG. 7 shows a schematic front view of a support surface of a bucket seat according to the present invention.

FIG. 7 shows in detail the support surface 14. The support surface 14 is formed of flexible side members 17 stitched with a covering 16, with the tensioning force being transmitted uniformly to the covering 16 with holders 15. With a permanently elastic covering 16, the holders 15 can be formed as rigid elements. The holders 15 can flatly lie on the covering 16 when they are displaced backward, so that the shape of the covering 16 is adapted to the contours of the body of a seating person. The rear side of the side members 17 is covered with two sheets of an elastic cloth having other ends stitched so that pockets are formed in which the shaped members 1 can be displaced.

Figure 8:
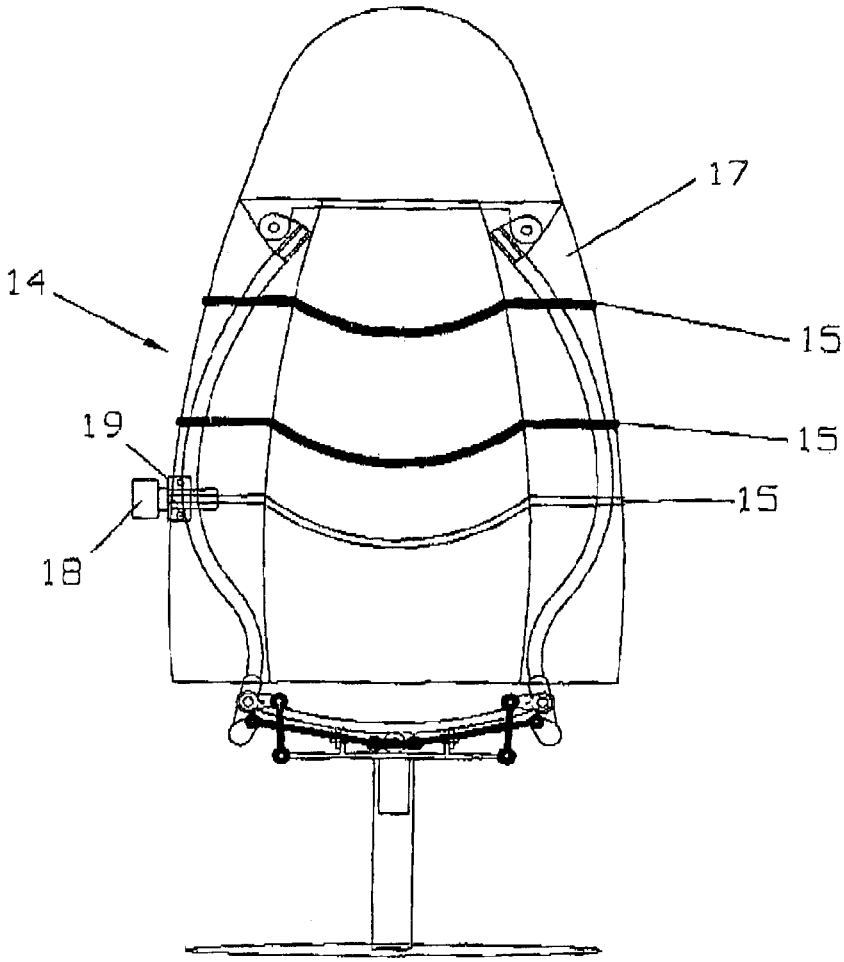
FIG. 8 shows a schematic front view of a support surface with means for controlling tensioning of a bucket seat according to the present invention.

FIG. 8 show means for adjusting the hardness of the covering 16, which can be advantageously effected in the support region of the lordosis. To this end there is provided a handwheel 18 which is secured in a bracket 19 attached to one of the side members 17.

The present invention is a significant contribution in the field of health care and does not require the use of external energy sources.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A bucket seat, comprising a seat; a backrest extending substantially transverse to the seat and having a flexible support surface and a plurality of curved shaped vertical members for supporting the support surface, the support surface abutting the curved shaped vertical supporting members along their entire longitudinal extent, members for receiving respective shaped members and extends in a same direction as the shaped members; and means for rotating the shaped members and the receiving members about respective vertical axes in opposite direction upon changing of an inclination of the support surface, with an alignment of respective shaped members and the receiving members being maintained, whereby a shape of the backrest changes upon changing inclination of the support surface, wherein the support surface is formed of spaced side members and a flexible, in a predetermined direction, covering connected with the side members, wherein the side members are rigid in a direction toward the covering but are bendable in a longitudinal direction, and wherein the bucket seat further includes holders for uniformly distributing a tensioning force over the covering.

* * * * *